US008841892B2

(12) United States Patent
Nagda et al.

(10) Patent No.: US 8,841,892 B2
(45) Date of Patent: Sep. 23, 2014

(54) METHOD AND INTEGRATED CIRCUIT THAT PROVIDES TRACKING BETWEEN MULTIPLE REGULATED VOLTAGES

(71) Applicants: Miten H. Nagda, Austin, TX (US); Dale J. McQuirk, Austin, TX (US)

(72) Inventors: Miten H. Nagda, Austin, TX (US); Dale J. McQuirk, Austin, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 116 days.

(21) Appl. No.: 13/686,901

(22) Filed: Nov. 27, 2012

(65) Prior Publication Data

US 2014/0145691 A1 May 29, 2014

(51) Int. Cl.
*G05F 1/577* (2006.01)
*G05F 1/00* (2006.01)

(52) U.S. Cl.
USPC ..... 323/269; 323/267; 323/272

(58) Field of Classification Search
USPC ..... 323/267, 269, 272
See application file for complete search history.

(56) References Cited

U.S. PATENT DOCUMENTS

| | | | | |
|---|---|---|---|---|
| 5,864,225 | A * | 1/1999 | Bryson | 323/268 |
| 5,969,512 | A * | 10/1999 | Matsuyama | 323/272 |
| 6,412,308 | B1 | 7/2002 | Lewis et al. | |
| 7,057,310 | B2 * | 6/2006 | Liu et al. | 307/126 |
| 7,274,114 | B1 * | 9/2007 | Wong | 307/72 |
| 7,622,901 | B2 * | 11/2009 | Noda | 323/267 |
| 7,795,848 | B2 * | 9/2010 | Aiura et al. | 323/269 |
| 7,852,052 | B2 * | 12/2010 | Vernon | 323/269 |
| 2007/0090815 | A1 * | 4/2007 | Hsieh | 323/269 |

* cited by examiner

*Primary Examiner* — Jue Zhang
(74) *Attorney, Agent, or Firm* — The Mason Group Patent Specialists LLC; Valerie M. Davis

(57) ABSTRACT

An IC provides tracking between multiple regulated voltages. The IC includes, a voltage reference circuit, a voltage multiplier circuit, and first and second voltage regulator circuits. The voltage reference circuit generates a first reference voltage. The first voltage regulator circuit generates, at a first terminal of a first output transistor, a first regulated voltage that is based on the first reference voltage. The voltage multiplier circuit generates a second reference voltage from an equivalent of the first reference voltage. The second voltage regulator circuit generates, at a first terminal of a second output transistor, a second regulated voltage that is based on the second reference voltage. At least one terminal of the second output transistor is capacitively coupled to the first terminal of the first output transistor.

20 Claims, 9 Drawing Sheets

METHOD AND INTEGRATED CIRCUIT THAT PROVIDES TRACKING BETWEEN MULTIPLE REGULATED VOLTAGES

FIELD

The present disclosure relates generally to voltage regulators and more particularly to a method and integrated circuit that provides tracking between multiple regulated voltages.

BACKGROUND

A system on chip (SOC) integrated circuit (IC) can require a supply voltage and well bias voltage to operate the transistors on the SOC. Well biasing is used, for example, to maintain the well voltage of a p-channel metal-oxide semiconductor (PMOS) transistor at a potential that exceeds its source voltage. This enables low-power modes of SOC operation (i.e., low power run modes) by increasing the transistor's threshold voltage and, thereby, reducing its sub-threshold leakage.

To enable proper transistor biasing during low-power run modes of the SOC, the difference or delta between the well bias voltage and the supply voltage should remain constant; otherwise timing issues may arise. During low-power run modes, the supply voltage can be noisy, and it is challenging to design a voltage regulator that produces a well bias voltage that tracks or follows the supply voltage under these conditions. An additional consideration is that any power used to create the well bias voltage reduces the efficiency of well biasing. Therefore, a low-power method of creating the well bias voltage is desirable.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
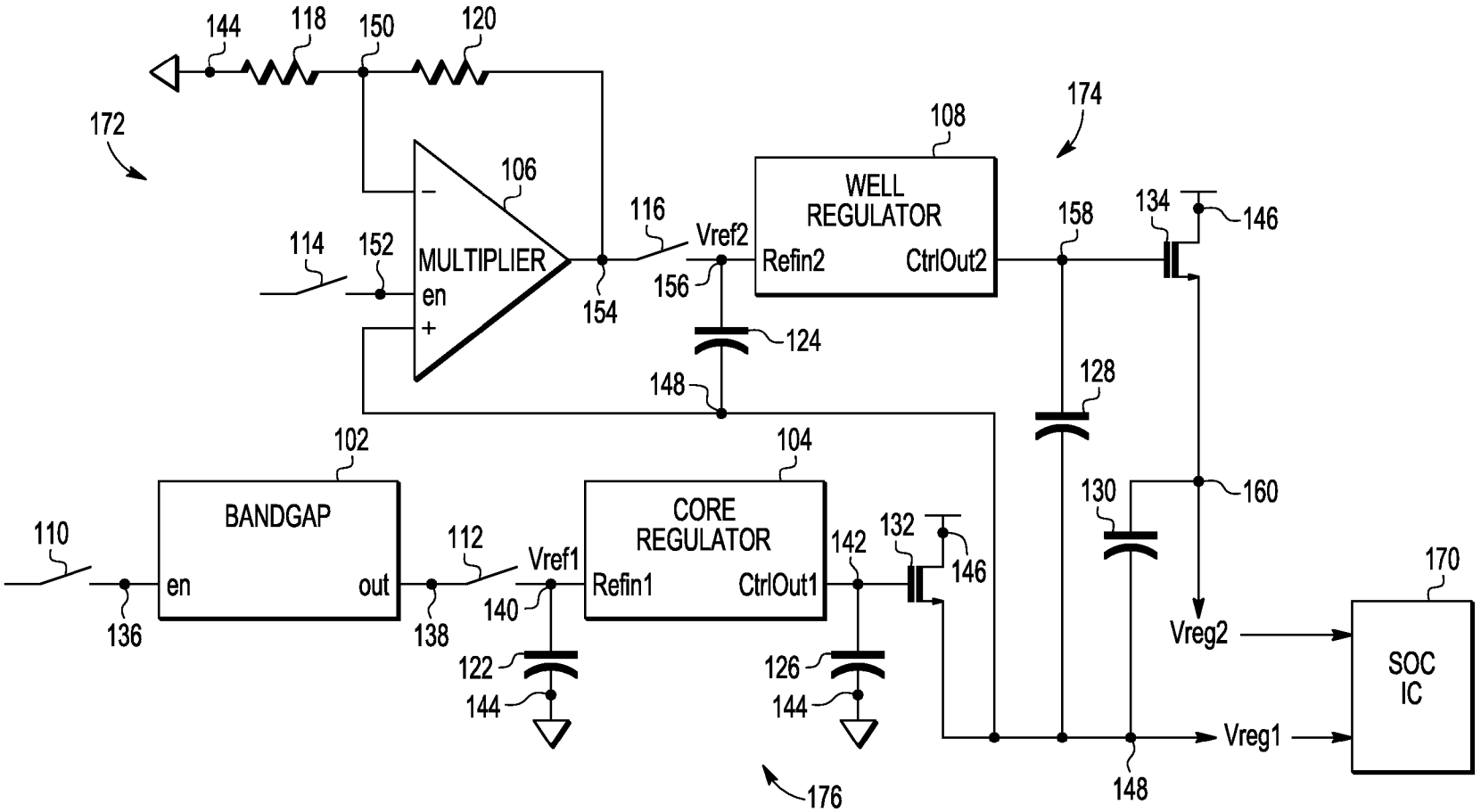
FIG. 1 is a circuit diagram illustrating an IC that provides tracking between multiple regulated voltages, in accordance with an embodiment.

Embodiments of the present invention are illustrated by way of example, and are not limited by the accompanying figures, in which like references indicate similar elements. Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

In accordance with an embodiment of the present disclosure is an IC that provides tracking between multiple regulated voltages. In one embodiment, the integrated circuit can comprise: a voltage reference circuit configured to generate a first reference voltage at an output of the voltage reference circuit; and a first voltage regulator circuit having an input coupled to the output of the voltage reference circuit. The first voltage regulator circuit can be configured to generate, at a first terminal of a first output transistor, a first regulated voltage that is based on the first reference voltage. The IC can further include a voltage multiplier circuit configured to generate, at an output of the voltage multiplier circuit, a second reference voltage from an equivalent of the first reference voltage, which is received into a first input of the voltage multiplier circuit. Moreover, the IC can include a second voltage regulator circuit having an input coupled to the output of the voltage multiplier circuit. The second voltage regulator circuit can be configured to generate, at a first terminal of a second output transistor, a second regulated voltage that is based on the second reference voltage, wherein at least one terminal of the second output transistor is capacitively coupled to the first terminal of the first output transistor.

In accordance with another embodiment of the present disclosure is a method for providing tracking between multiple regulated voltages. The method can include: generating, on an integrated circuit, a first reference voltage; and generating, on the integrated circuit, a second reference voltage from an equivalent of the first reference voltage. The method can further include generating a first regulated voltage that is based on the first reference voltage, wherein the first regulated voltage is generated at an output of a first voltage regulator circuit on the integrated circuit. Moreover, the method can include generating a second regulated voltage that is based on the second reference voltage, wherein the second regulated voltage is generated at an output of a second voltage regulator circuit on the integrated circuit, and wherein the second regulated voltage follows the first regulated voltage using a capacitive coupling between the second voltage regulator circuit and the output of the first voltage regulator circuit.

Turning now to FIG. 1, shown therein is an IC 100 that provides tracking of multiple regulated voltages in accordance with an embodiment of the present disclosure. IC 100 includes: a voltage reference circuit 102; a first voltage regulator circuit 176 comprising a regulator 104 and a first output transistor 132; a voltage multiplier circuit 172 comprising an operational amplifier (also referred to as a multiplier) 106 and resistors 118 and 120; and a second voltage regulator circuit 174 comprising a regulator 108 and a second output transistor 134. In an embodiment, the IC 100 provides, to a SOC IC 170 such as a microcontroller, a first regulated voltage Vreg1 at an output node 148 and a second regulated voltage Vreg2 at an output node 160, wherein Vreg2 "tracks" or "follows" the changes of Vreg1 under various operating conditions of the IC 100 and of the SOC 170 coupled to the IC 100, as explained in detail below.

A signal "tracking" or "following" another signal means that instantaneous changes to the tracked signal (i.e., changes to the value of the tracked signal over some tracking time frame) is substantially mirrored by the tracking signal. In order for a signal to track another signal, the two signals need not have the same value during the tracking time frame, just that the changes to both signals are substantially the same. As a consequence, the delta or difference between the tracking and the tracked signal (for instance the delta or difference between two regulated output voltages) remains substantially constant over the tracking time frame.

In an embodiment, the first regulated voltage, Vreg1, is a supply voltage for a set of transistors of a system on chip integrated circuit (SOC IC). For instance, Vreg1 is a supply voltage, Vdd, provided to source terminals of one or more PMOS transistors on the SOC IC 170. Thus, Vreg1 is also referred to herein as a regulated output supply voltage, and the regulator 104 is also referred to herein as a "core" regulator. In an embodiment, Vreg1 is regulated to or maintained at a potential of substantially 1.2 Volts (V) during the operation of the SOC IC 170. This means that if circuit 100 and/or 170 start-up or various transients such as changes to loads and temperature perturbations of IC 170, for instance, cause a momentary change to the Vreg1 potential, the core regulator 104 operates to bring Vreg1 back to the 1.2V level.

In an embodiment, second regulated voltage, Vreg2, is a well bias voltage for the set of transistors of the system on chip integrated circuit. For instance, Vreg2 is a well bias voltage provided to the well of the one or more PMOS transistors on the SOC IC 170. Thus, Vreg2 is also referred to herein as a regulated output well voltage, and the regulator 108 is also referred to herein as a "well" regulator. In an embodiment, Vreg2 is regulated to or maintained at a potential of substantially 1.6 Volts (V) during a low-power run or operation mode of the SOC IC 170. This means that if circuit 100 and/or 170 start-up or various transients such as changes to loads and temperature perturbations of IC 170, for instance, cause a momentary change to the Vreg2 potential, the well regulator 108 operates to bring Vreg2 back to the 1.6V level. Accordingly, it can be said that the voltage reference circuit 102, the first and second voltage regulator circuits 174 and 176, respectively, and the voltage multiplier circuit 172 are collectively configured to provide the second regulated voltage Vreg2 at a value (e.g., 1.6 V) that is higher than a value (e.g., 1.2V) of the first regulated voltage Vreg1.

Turning now to the details of the components and the connectivity of the components of the IC 100. The voltage reference circuit 102 comprises an enable (en) input connected to a node 136 and an output (out) connected to a node 138 and is configured to generate the first reference voltage, Vref1, at its output. In an embodiment, the voltage reference circuit 102 is a temperature independent bandgap voltage reference.

The core regulator 104 comprises an input (Ref in1) connected to a node 140 and an output (CtrlOut1) connected to a node 142, and the input (Ref in1) is coupled to the output (out) of the voltage reference circuit 102. The core regulator 104 is configured to receive Vref1 and to generate a control voltage at the node 142 that is provided to a gate terminal of the output transistor 132. In an embodiment, the gate control voltage provided at the output (CtrlOut1) of the core regulator 104 is maintained at a value that is the same or substantially the same as Vref1, e.g., around 1.2 V.

In an embodiment, the output transistor 132 is an n-channel metal-oxide semiconductor (NMOS) transistor having a first (source) terminal connected to the node 148, a second (drain) terminal connected to a supply node 146 to receive a supply voltage (e.g., anywhere between 1.7 and 3.6 V, such as 3 V), and the gate terminal connected to the node 142 to receive the control signal provided by the core regulator 104. In accordance with this circuit arrangement, the output transistor 132 is configured to conduct in response to the control signal placed on its gate at the node 142. Consequently, using the output transistor 132, the first voltage regulator circuit 176 is configured to generate, at the first (source) terminal of the first (NMOS) output transistor 132, the first regulated voltage (Vreg1), which is based on the first reference voltage (Vref1).

More particularly, at power up as the control signal at the gate of transistor 132 rises, the transistor 132 increasingly conducts current to provide an output voltage at it's source terminal that rises with the voltage at the gate terminal until reaching a value (or range of values) that is maintained during normal IC 100 and/or 170 operation. Normal IC operation means IC operation during times when there are no perturbations, fluctuations, or anomalies that occur which temporarily raise or lower Vreg1, such as during power up of the core regulator 104 or a load change at the node 148. In this illustrative circuit implementation, Vreg1 is regulated or maintained to be the same or substantially the same as Vref1, e.g., around 1.2 V during normal IC operation.

The voltage multiplier circuit 172, and more particularly the operational amplifier 106 of the voltage multiplier circuit 172, comprises a first (non-inverting) input coupled to receive an "equivalent" of Vref1, meaning a signal having substantially the same value as Vref1. In the embodiment shown in FIG. 1, the first (source) terminal of the first output transistor (132) is coupled to the first (non-inverting) input of the voltage multiplier circuit 172. More particularly, the first terminal of the first output transistor 132 is directly connected to the first input of the voltage multiplier circuit 172, at the node 148, in order to receive the equivalent of Vref1, which in this case is Vreg1. However, in an alternative arrangement, other intervening elements may be inserted, such as one or more resistors, between the non-inverting input of the multiplier 106 and the source terminal of the NMOS transistor 132.

Resistor 118 of the voltage multiplier circuit 172 is connected between virtual ground at a node 144 and a second (inverting) input of the voltage multiplier circuit (more particularly the inverting input of the multiplier 106) at a node 150. In an embodiment, the virtual ground is 0 V but can be any suitable voltage that is lower than the supply voltage at the node 146. Resistor 120 of the voltage multiplier circuit 172 is connected between the node 150 and an output of the voltage multiplier circuit (more particularly the output of the multiplier 106) at a node 154. In an embodiment, the values of resistors 118 and 120 total less than 120 kilo-ohms.

The voltage multiplier circuit 172 is configured to generate, at the output of the voltage multiplier circuit (at the node 154), a second reference voltage, Vref2 from or based on an equivalent of the first reference voltage Vref1, wherein the equivalent of Vref1 is received into the first input of the voltage multiplier circuit. In this embodiment, the voltage multiplier circuit 172 is configured to generate Vref2 from Vreg1, at the node 154. More particularly, Vreg1 is the equivalent of Vref1; and to generate Vref2, the voltage multiplier circuit 172 generates a multiple of Vreg1 at its output. The multiple is determined by the ratio of the values of resistors 118 and 120. In an embodiment, Vref2 is generated to be about 1.6V.

The well regulator 108 comprises an input (Ref in2) connected to a node 156 and an output (CtrlOut2) connected to a node 158, and the input (Ref in2) is coupled to the output of the voltage multiplier circuit 172. The well regulator 108 is configured to receive Vref2 and to generate a control voltage at the node 158 that is provided to a gate terminal of the output transistor 134. In an embodiment, the gate control voltage provided at the output (CtrlOut2) of the well regulator 108 is maintained at a value that is the same or substantially the same as Vref2, e.g., around 1.6 V.

In an embodiment, the output transistor 134 is an NMOS transistor having a first (source) terminal connected to a node 160, a second (drain) terminal connected to the supply node 146 to receive the supply voltage (e.g., anywhere between 1.7 and 3.6 V, such as 3 V), and the gate terminal connected to the node 158 to receive the control signal provided by the well regulator 108. In accordance with this circuit arrangement, the output transistor 134 is configured to conduct in response to the control signal placed on its gate at the node 158. Consequently, using the output transistor 134, the second voltage regulator circuit 174 is configured to generate, at the first (source) terminal of the second (NMOS) output transistor (134), the second regulated voltage (Vreg2), which is based on the second reference voltage (Vref2).

More particularly, at power up as the control signal at the gate of transistor 134 rises, the transistor 134 increasingly conducts current to provide an output voltage at it's source terminal that rises with the voltage at the gate terminal until reaching a value (or range of values) that is maintained during normal IC 100 and/or 170 operation. In this illustrative circuit implementation, Vreg2 is regulated or maintained to be the same or substantially the same as Vref2, e.g., around 1.6 V during normal IC operation.

In accordance with the teachings herein, at least one terminal of the second output transistor 134 is capacitively coupled to the first (source) terminal of the first output transistor 132. Such capacitive coupling is affected using one or more capacitive elements or components, such as one or more capacitors. This capacitive coupling beneficially enables AC tracking between Vreg1 and Vreg2 under a number of circuit operating conditions. For example, using the capacitive coupling in accordance with embodiments of the present disclosure, for instance as described herein, enables Vreg2 (e.g., the PMOS well bias voltage) to track Vreg1 (e.g., the PMOS source voltage) over transients, such as during power up or as a result of a change (e.g., increase or decrease) in a load within the SOC IC 170, which is attached to the source terminal of transistor 132 at the node 148.

In one embodiment, the capacitive coupling between the at least one terminal of the second output transistor 134 and the first (source) terminal of the first output transistor 132 comprises a first capacitor 128 having a first terminal connected to the gate terminal of the second output transistor 134 (at the node 158) and a second terminal connected to the first (source) terminal of the first output transistor 132 (at the node 148). Capacitor 128 enables perturbations to Vreg1 to be reflected on the control voltage of the gate of transistor 134. This causes Vreg2 to follow the perturbations of Vreg1 to maintain the delta between Vreg1 and Vreg2 independent of those perturbations.

In a further embodiment, the capacitive coupling between the at least one terminal of the second output transistor 134 and the first (source) terminal of the first output transistor 132 comprises a second capacitor 130 having a first terminal connected to the first (source) terminal of the second output transistor 134 (at the node 160) and a second terminal connected to the first (source) terminal of the first output transistor 132 (at the node 148). Capacitor 130 also provides AC coupling between Vreg1 and Vreg2 but to a lesser extent than capacitor 128 in at least some implementation scenarios such as when the capacitance provided by the SOC IC 170 at node 160 is much greater than the capacitance at the gate terminal of second output transistor 134. In the embodiment shown in FIG. 1, both capacitors 128 and 130 are implemented within the circuit. However, in one arrangement, one or the other of capacitors 128 or 130 (but not both) are implemented within the IC 100.

Further in accordance with the teachings herein, IC 100 comprises a sample and hold circuit coupled between the input of the first voltage regulator circuit 176 and the output of the voltage reference circuit 102 and coupled between the input of the second voltage regulator circuit 174 and the output of the voltage multiplier circuit 172. In the embodiment illustrated, the sample and hold circuit comprises: a first switch 112 connected between the input of the first voltage regulator circuit (at the node 140) and the output of the voltage reference circuit 102 (at the node 138); and a second switch 116 connected between the input of the second voltage regulator circuit (at the node 156) and the output of the voltage multiplier circuit (at the node 154). The first and second switches 112, 116 are configured to open and close under the control of a first clock signal.

The sample and hold circuit further comprises: a first capacitor (122) having a first terminal connected to the input of the first voltage regulator circuit (at the node 140) and a second terminal connected to the virtual ground node (at the node 144); and a second capacitor 124 having a first terminal connected to the input of the second voltage regulator circuit (at the node 156) and a second terminal. In alternative embodiments, the second terminal of the second capacitor 124 is connected to one of (i.e., either) the virtual ground node 144 or the first terminal of the first output transistor 132, at the node 148 (as shown in FIG. 1). Further AC coupling (and hence tracking) between Vreg1 and Vreg2 is provided when the second terminal of the capacitor 124 is connected to node 148.

Using the sample and hold circuit, Vref1 and Vref2 are sampled under the control of the first clock signal, and charge is stored on the capacitors 122 and 124 to provide Vref1 and Vref2, respectively, to the inputs of the core regulator 104 and the well regulator 108. Thus, Vref1 and Vref2 can be beneficially provided without continuously operating the bandgap voltage reference 102 and the multiplier 106, which are higher power devices. To this end, IC 100 further comprises a third switch 114 coupled to the voltage multiplier circuit (at a node 152) and configured to enable operation the voltage multiplier circuit 172 (and more particularly the multiplier 106). IC 100 also comprises a fourth switch 110 coupled to the voltage reference circuit 102 (at a node 136) and configured to enable operation the voltage reference circuit 102. The third and fourth switches 114, 110 are configured to open and close under the control of a second clock signal. In an embodiment, the first clock signal (that controls switches 112 and 116) is a delayed version of the second clock signal (that controls switches 110 and 114). This provides the bandgap voltage reference 102 and voltage multiplier circuit 172 time to stabilize and provide the base reference voltages Vref1 and Vref2 before providing Vref1 and Vref2 to the other components with the IC 100. In another embodiment, all of the switches are controlled using the same clock signal. A benefit of using the sample and hold circuit and the switches 110 and 114 is lower power operation of IC 100. This occurs because the higher power bandgap 102 and multiplier 106 components are not always on. The frequency of the one or more clock signals that operate the switches can be optimized for peak power efficiency.

Additionally, the IC 100 includes a capacitor 126 connected between the gate of transistor 132 at the node 142 and the virtual ground node 144. Capacitor 126 stores charge to hold the gate control signal for transistor 132, for instance at a value of about 1.2 V during normal IC operation. In an embodiment, the capacitors 122-130 have values ranging between 2-30 Pico farads depending on factors including, but not limited to, chip size, the size of the core and well regulators, leakage control for the switches, and desired temperature range of operation for the IC 100.

Figure 2:
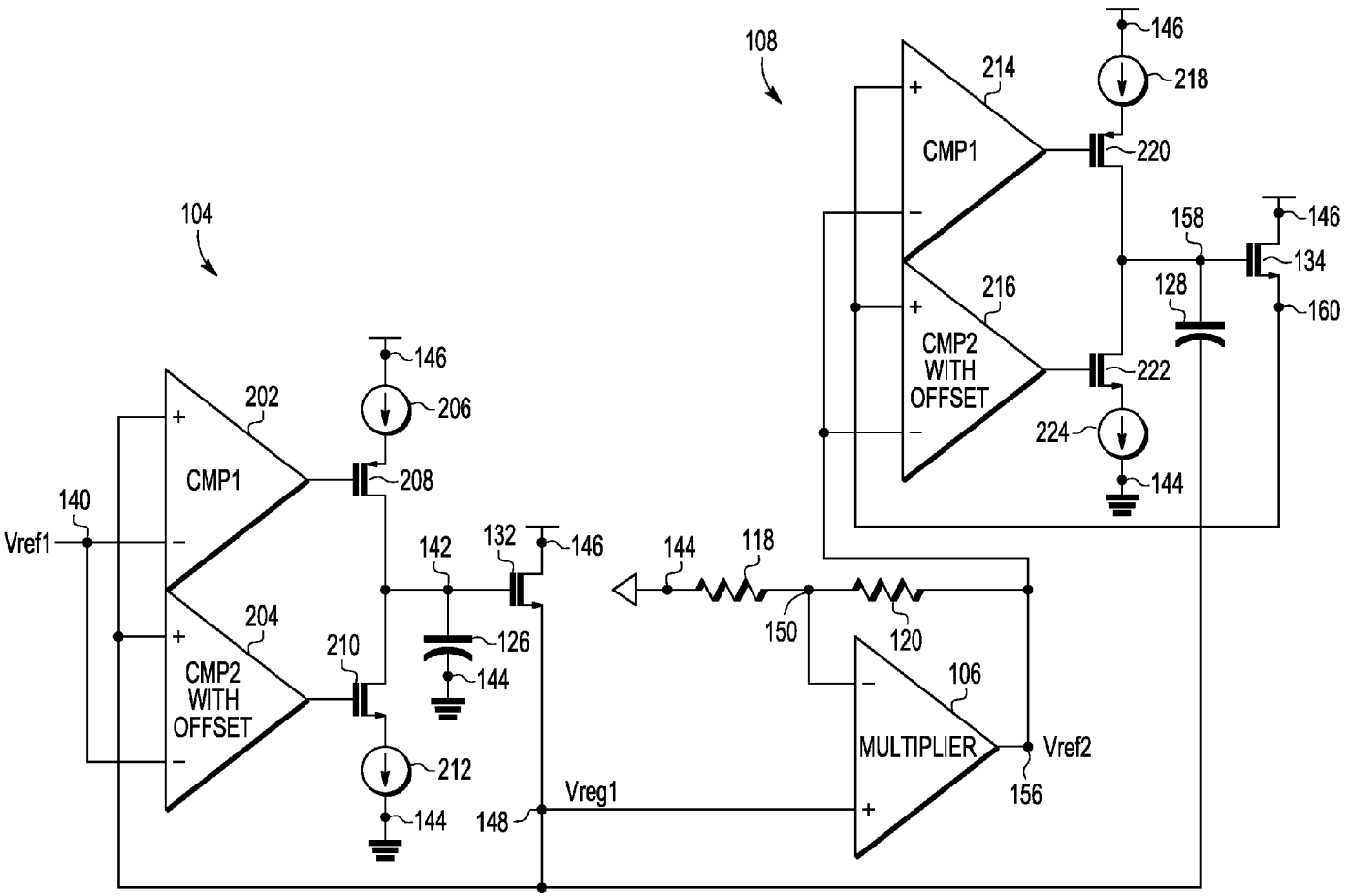
FIG. 2 is a circuit diagram illustrating details of core and well regulators within the IC shown in FIG. 1.

Turning now to FIG. 2, illustrated therein is a portion (200) of the IC 100 showing details of an embodiment of the core regulator 104 and the well regulator 108. Transistors 132 and 134 and the voltage multiplier circuit 172 are arranged and coupled as shown in FIG. 1. In the embodiment shown, the core and well regulators 104, 108 are implemented as "dead-band" regulators, meaning that the regulators are configured to have a voltage range where a loop control within the regulator does not adjust the output voltage from the regulator (e.g., at the node 142 or the node 158). The voltage range or band within which no loop control is performed is called the "dead band." A benefit of using dead band regulators is to minimize operation of higher power components (e.g., comparators) for power efficiency or lower power operation of the IC 100.

In general, the first voltage regulator circuit 176 comprises a first set of comparators 202, 204 coupled to the first (source) terminal of the first output transistor, 132 (at the node 148), wherein the first set of comparators are configured to adjust a value of the first regulated voltage (Vreg1) when it is outside of a first voltage range (i.e., the first dead band) and are configured to maintain the value of the first regulated voltage (Vreg1) when it is within the first voltage range. More specifically, the core regulator 104 comprises comparators 202 and 204, wherein comparator 204 has a trip point having an offset from the trip point of comparator 202 to provide for the first dead band. The core regulator 104 further comprises a p-channel metal-oxide semiconductor (PMOS) transistor 208 and an NMOS transistor 210. The comparators 202 and 204 each have a non-inverting input connected to the node 148 to receive Vreg1 and an inverting input connected to the node 140 to receive Vref1. The PMOS transistor 208 has its source connected to the voltage supply node 146, its gate connected to the output of comparator 202 and its drain connected to the gate of the transistor 132, at the node 142. The NMOS transistor 210 has its source connected to the virtual ground node 144, its gate connected to the output of the comparator 204 and its drain connected to the gate of the transistor 132, at the node 142.

During operation, the comparator 202 protects against an under voltage condition and the comparator 204 protects against an over voltage condition. When the difference (Vreg1−Vref1) drops below the negative trip point of comparator 202 (for instance due to load changes at the node 148), the comparator 202 is configured to turn on transistor 208 in order to source current (206) from the voltage supply connected to the node 146 and, thereby, raise the voltage on the gate of transistor 132 and, consequently, raise Vreg1. Conversely, when the difference (Vreg1−Vref1) exceeds the positive trip point of comparator 204 (for instance due to load changes at the node 148), the comparator 204 is configured to turn on transistor 210 in order to sink current 212 into the virtual ground at the node 144 and, thereby, lower the voltage on the gate of transistor 132 and, consequently, lower Vreg1. When Vreg1 is within the first dead band, the comparators 202 and 204 are off and Vreg1 is not adjusted. In this manner, the core regulator 104 provides a control loop between node 148 and the non-inverting inputs of the comparators 202 and 204 to maintain the value of Vreg1 at a substantially constant potential, e.g., about 1.2 volts within a tolerance corresponding to the first dead band, which in one embodiment is 200 mV above and below Vref1.

Similarly, the second voltage regulator circuit 174 comprises a second set of comparators 214, 216, coupled to the first (source) terminal of the second output transistor, 134, wherein the second set of comparators are configured to adjust a value of the second regulated voltage (Vreg2) when it is outside of a second voltage range (i.e., the second dead band) and are configured to maintain the value of the second regulated voltage (Vreg2) when it is within the second voltage range. More specifically, the well regulator 108 comprises comparators 214 and 216, wherein comparator 216 has a trip point having an offset from the trip point of comparator 214 to provide for the second dead band. The well regulator 108 further comprises a PMOS transistor 220 and an NMOS transistor 222. The comparators 214 and 216 each have a non-inverting input connected to the node 160 to receive Vreg2 and an inverting input connected to the node 156 to receive Vref2. The PMOS transistor 220 has its source connected to the voltage supply node 146, its gate connected to the output of comparator 214 and its drain connected to the gate of the transistor 134, at the node 158. The NMOS transistor 222 has its source connected to the virtual ground node 144, its gate connected to the output of the comparator 216 and its drain connected to the gate of the transistor 134, at the node 158.

During operation, the comparator 214 protects against an under voltage condition and the comparator protects against an over voltage condition. When the difference (Vreg2−Vref2) drops below the negative trip point of comparator 214, the comparator 214 is configured to turn on transistor 220 in order to source current (218) from the voltage supply connected to the node 146 and, thereby, raise the voltage on the gate of transistor 134 and, consequently, raise Vreg2. Conversely, when the difference (Vreg2-Vref2) exceeds the positive trip point of comparator 216, the comparator 216 is configured to turn on transistor 222 in order to sink current (224) into the virtual ground at the node 144 and, thereby, lower the voltage on the gate of transistor 134 and, consequently, lower Vreg2. When Vreg2 is within the second dead band, the comparators 214 and 216 are off and Vreg2 is not adjusted. In this manner, the well regulator 108 provides a control loop between node 160 and the non-inverting inputs of the comparators 214 and 216 to maintain the value of Vreg2 at a substantially constant potential, e.g., about 1.6 volts within a tolerance corresponding to the second dead band, which in one embodiment is 400 mV above and below Vref2.

Figure 3:
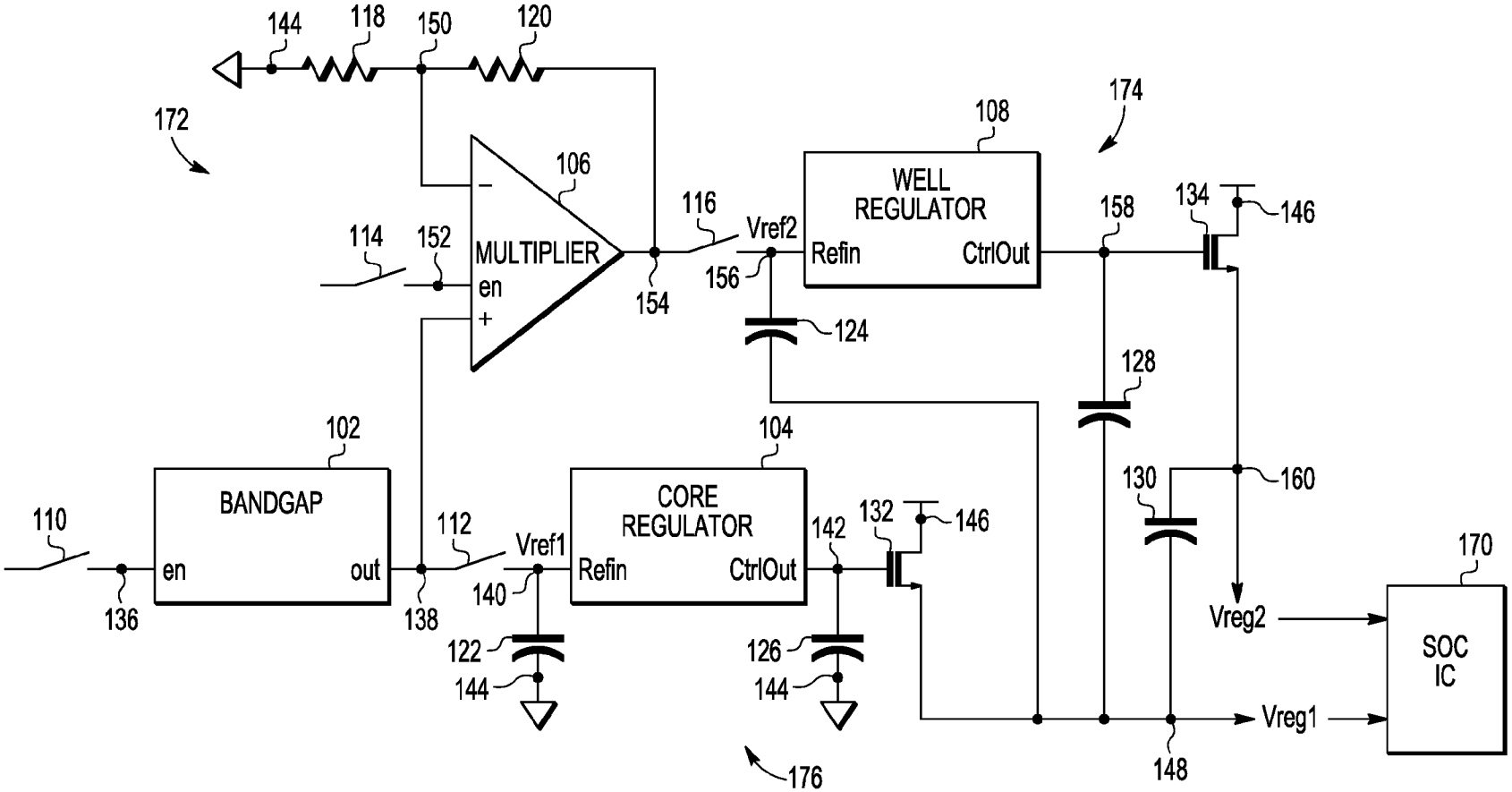
FIG. 3 is a circuit diagram illustrating an IC that provides tracking between multiple regulated voltages, in accordance with another embodiment.

Turning now to FIG. 3, illustrated therein is a circuit diagram illustrating an IC 300 that provides tracking between multiple regulated voltages Vreg1 and Vreg2, in accordance with alternate embodiment. The embodiment of IC 300 is similar to the IC 100 embodiment shown in FIG. 1, having similar components and connectivity as the components shown in FIG. 1 as illustrated by the reference numbers that are repeated in FIGS. 1 and 3. A difference between IC 100 and IC 300 is the connectivity of the non-inverting (first) input of the multiplier 106. In IC 300, the first input of the voltage multiplier circuit 172 (more particularly the first (non-inverting) input of the multiplier 106) is coupled to the output of the voltage reference circuit 102. Specifically, in the embodiment illustrated, the first (non-inverting) input of the voltage multiplier circuit is directly connected to the output of the voltage reference circuit, at the node 138. This embodiment provides slightly less responsive AC tracking than the embodiment shown in FIG. 1.

Figure 4:
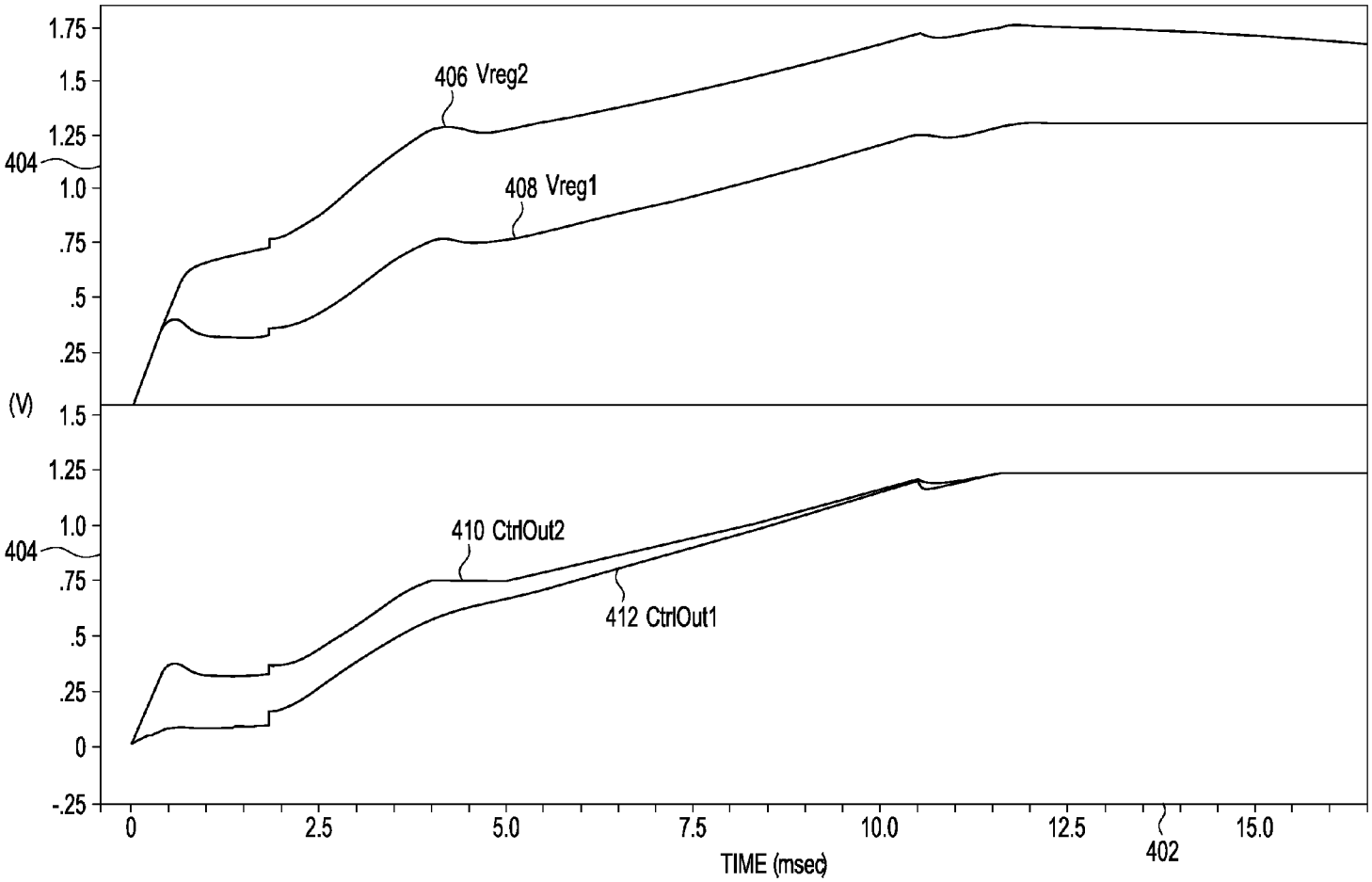
FIG. 4 shows waveforms illustrating tracking between two regulated voltages generated by the ICs depicted in FIG. 1 and FIG. 3 during IC power up.

FIGS. 4-8 illustrate waveforms 400 that demonstrate the AC tracking at various points or nodes within ICs 100 and 300. FIG. 4 shows waveforms 406-412 comprising plots of voltage (in V) on an axis 404 versus time (in msec) on an axis 402. Waveforms 406-412 illustrate tracking between the two regulated voltages Vreg1 and Vreg2 generated by the ICs depicted in FIG. 1 and FIG. 3, during IC power up. Particularly, waveforms 410 and 412 show the control signals at the gates of transistors 134 and 132, respectively, during IC 100 power up. Even early on in the power up process, waveform 406 (illustrating Vreg2) is shown to be tracking waveform 408 (illustrating Vreg1).

Figure 5:
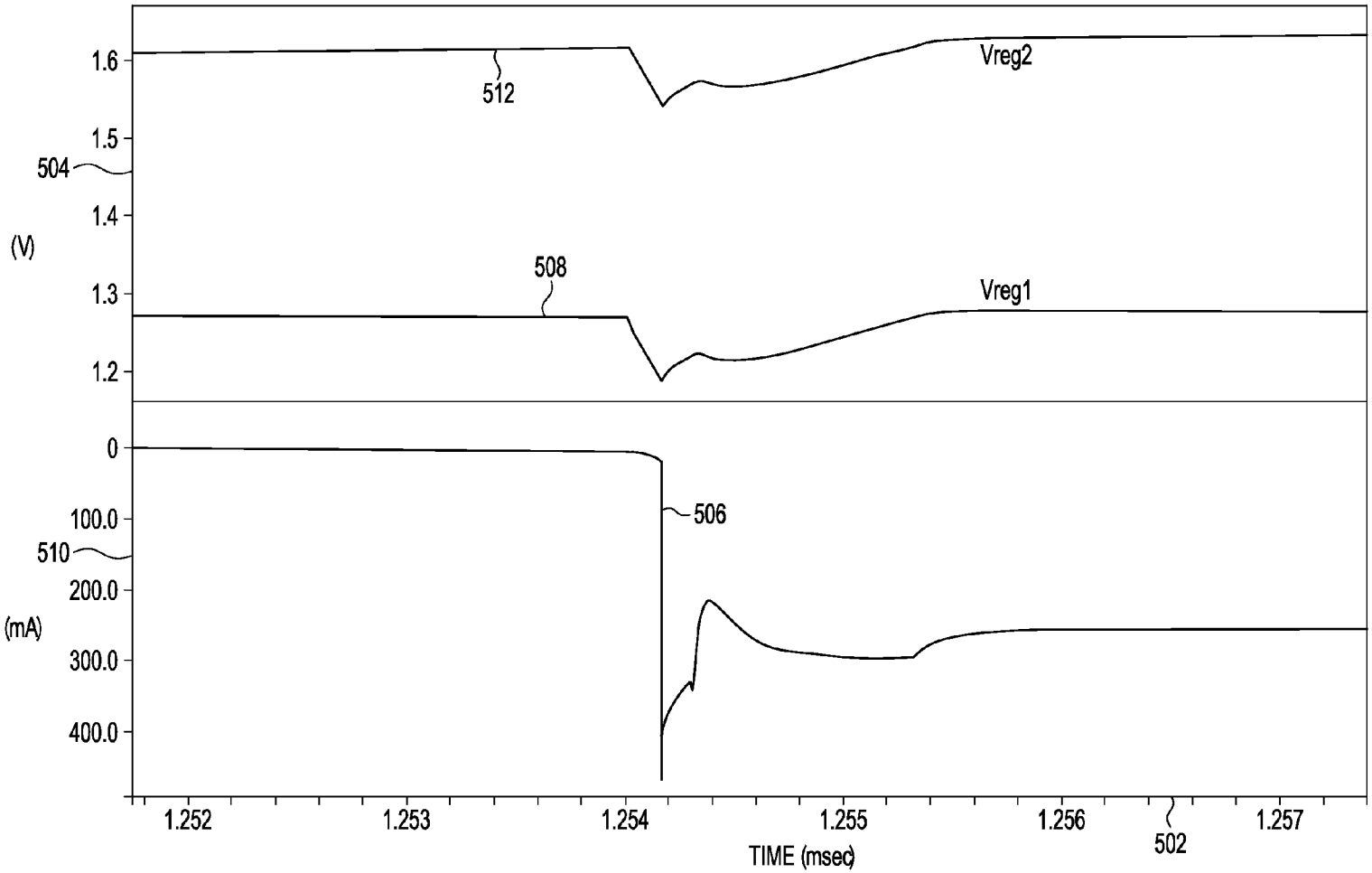
FIG. 5 shows waveforms illustrating tracking between two regulated voltages generated by the ICs depicted in FIG. 1 and FIG. 3 during a load increase.

FIG. 5 shows waveforms comprising plots 508 and 512 of voltage (in V) on an axis 504 versus time (in msec) on an axis 502 and plot 506 of current (in mA) on an axis 510 versus time on the axis 502. Waveforms 506, 508, and 512 illustrate tracking between the two regulated voltages Vreg1 and Vreg2 generated by the ICs depicted in FIG. 1 and FIG. 3 during a load increase. Particularly, waveform 506 illustrates the load increase from 0 mA to about 250 mA. During the load increase, waveform 512 (illustrating Vreg2) is shown to be tracking waveform 508 (illustrating Vreg1).

Figure 6:
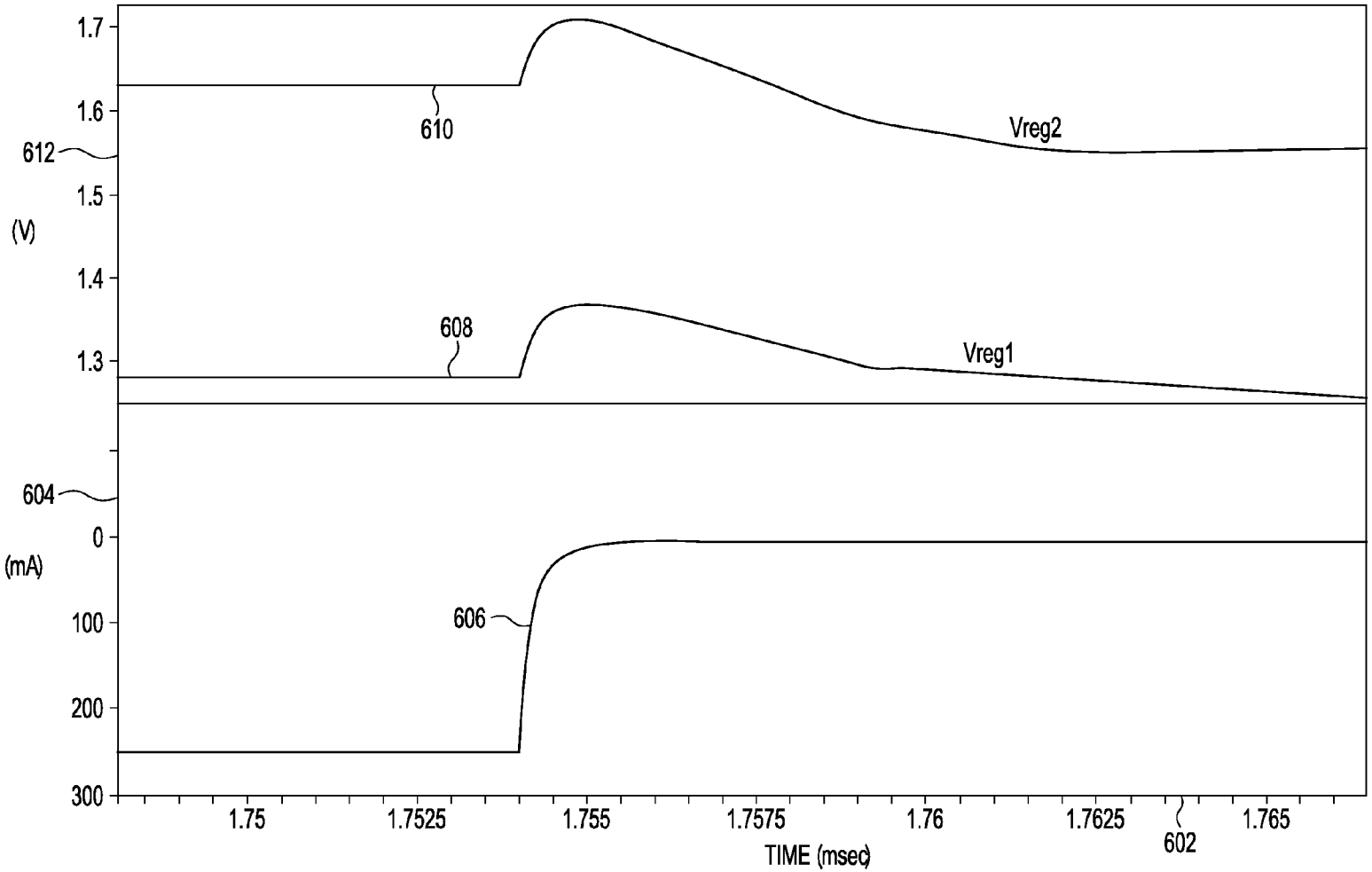
FIG. 6 shows waveforms illustrating tracking between two regulated voltages generated by the ICs depicted in FIG. 1 and FIG. 3 during a load decrease.

FIG. 6 shows waveforms comprising plots 608 and 610 of voltage (in V) on an axis 612 versus time (in msec) on an axis 602 and plot 606 of current (in mA) on an axis 604 versus time on the axis 602. Waveforms 606-610 illustrate tracking between the two regulated voltages Vreg1 and Vreg2 generated by the ICs depicted in FIG. 1 and FIG. 3 during a load decrease. Particularly, waveform 606 illustrates the load decrease from about 250 mA to 0 mA. During the load decrease, waveform 610 (illustrating Vreg2) is shown to be tracking waveform 608 (illustrating Vreg1).

Figure 7:
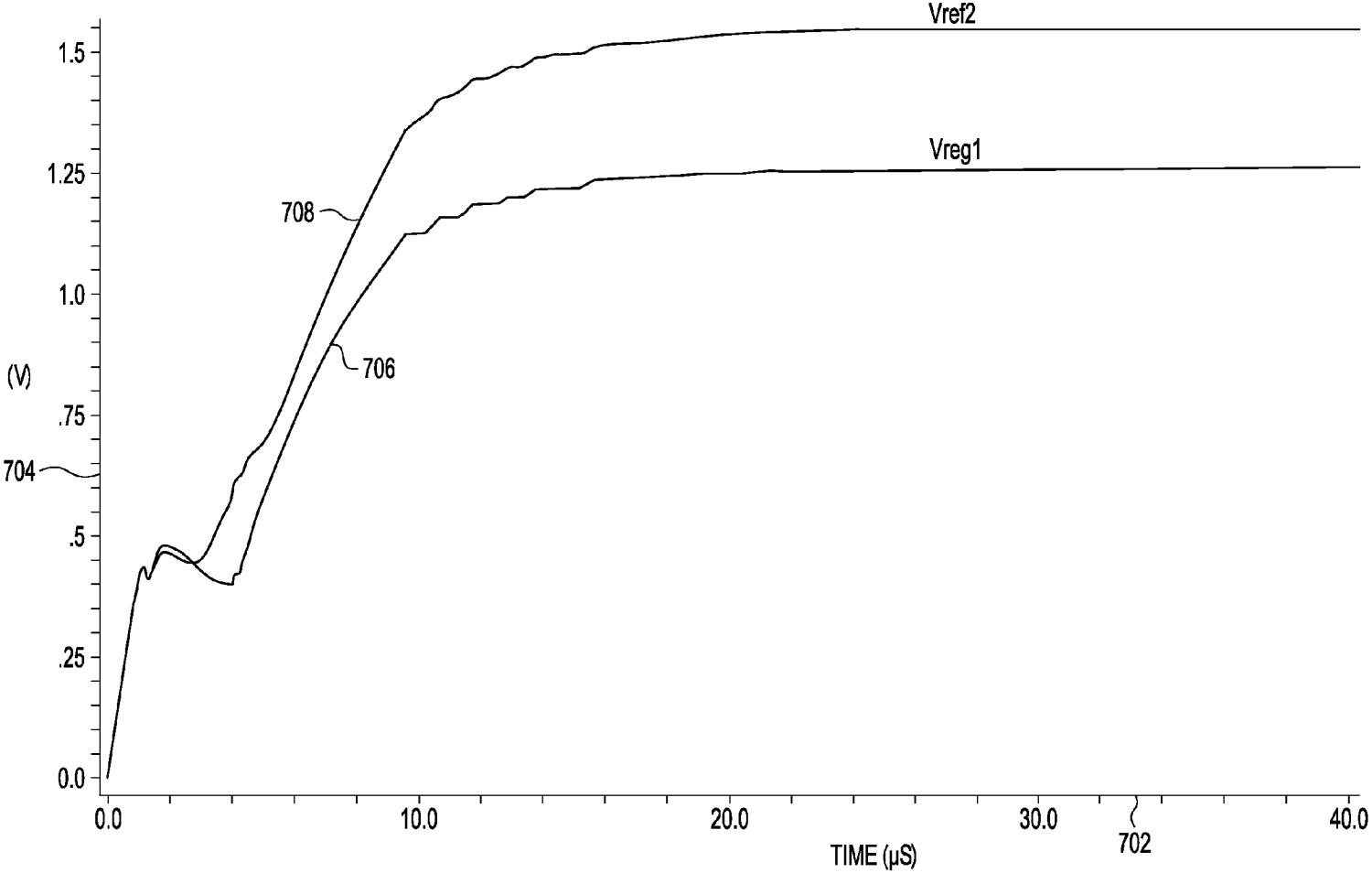
FIG. 7 shows waveforms illustrating tracking between an input reference voltage to the well regulator and a regulated output supply voltage generated by the IC depicted in FIG. 1 during IC power up.
Figure 8:
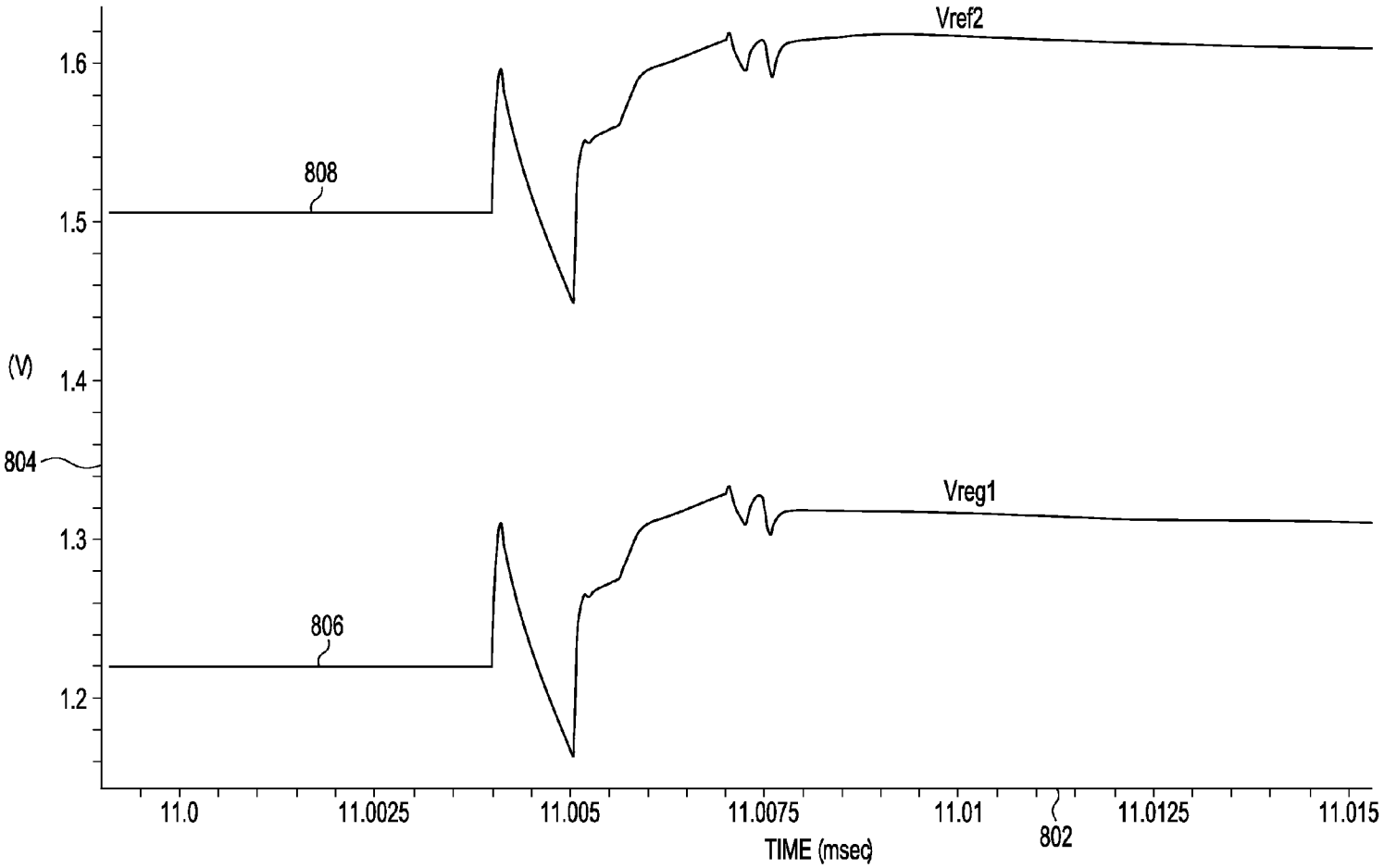
FIG. 8 shows waveforms illustrating tracking between an input reference voltage to the well regulator and a regulated output supply voltage generated by of the IC depicted in FIG. 1 during a load change.

FIGS. 7 and 8 are particular to the embodiment shown in FIG. 1, where the non-inverting input of the multiplier 106 is connected to the node 148. FIG. 7 shows waveforms 706 and 708 comprising plots of voltage (in V) on an axis 704 versus time (in msec) on an axis 702. During IC 100 power up, waveform 708 (illustrating Vref2, the input reference voltage to the well regulator 108) is shown to be tracking waveform 706 (illustrating Vreg1, the regulated output supply voltage at node 148). Similarly, FIG. 8 shows waveforms 806 and 808 comprising plots of voltage (in V) on an axis 804 versus time (in msec) on an axis 802. During a load change at node 148, waveform 808 (illustrating Vref2, the input reference voltage to the well regulator 108) is shown to be tracking waveform 806 (illustrating Vreg1, the regulated output supply voltage at node 148).

Figure 9:
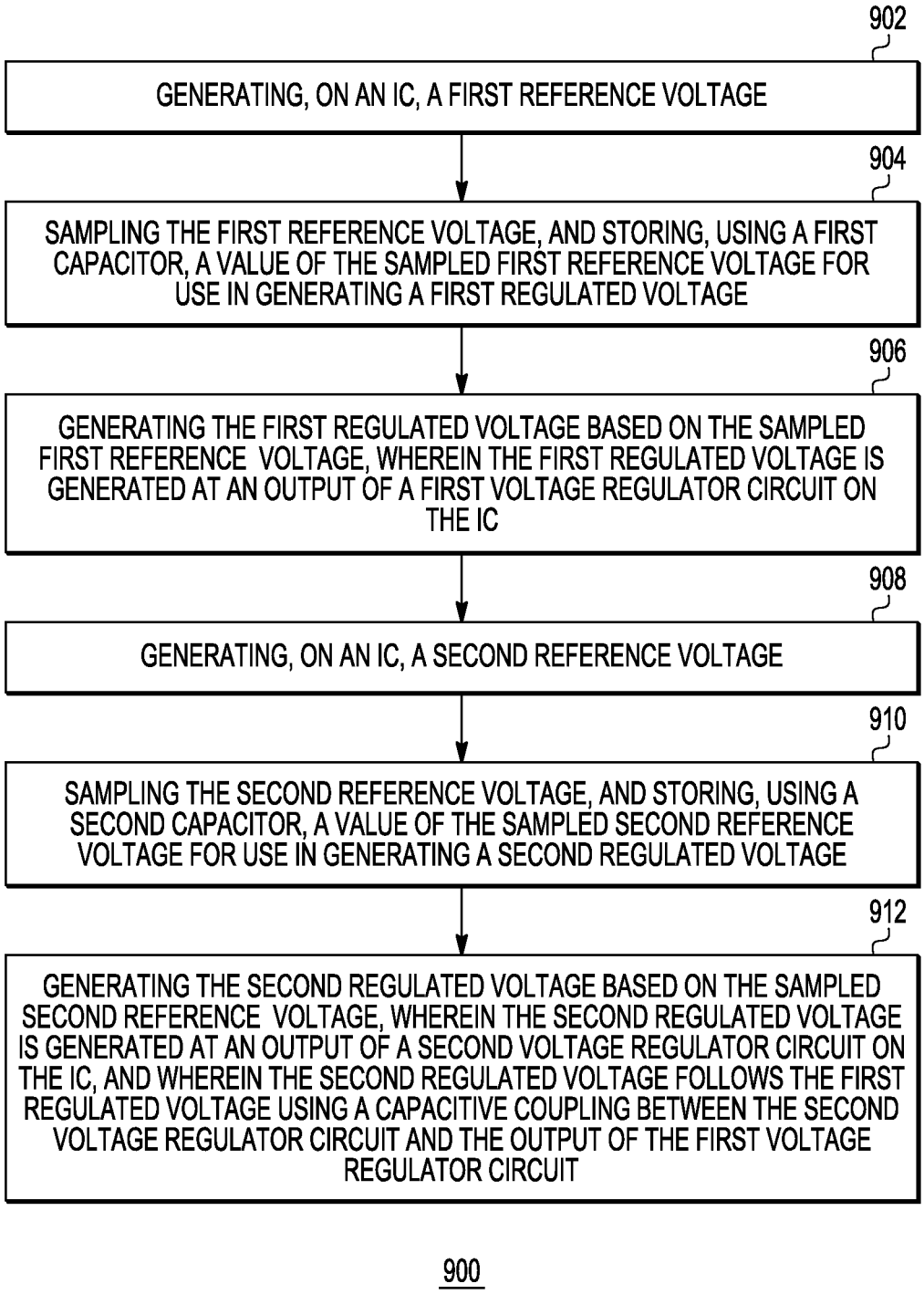
FIG. 9 illustrates a flow diagram of a method for providing tracking between multiple regulated voltages, in accordance with an embodiment.

Turning now to FIG. 9, illustrated therein is a flow diagram of a method 900 for providing tracking between multiple regulated voltages, in accordance with an embodiment. For example, method 900 is implemented by the IC 100 of FIG. 1 or the IC 300 of FIG. 3. Turning to the details of the method 900. At 902, the bandgap reference 102 generates a first reference voltage Vref1 on the IC (100 or 300). In an embodiment, the sample and hold circuit is used, at 904, for sampling the first reference voltage Vref1, and storing, using a first capacitor 122, a value of the sampled first reference voltage for use in generating a first regulated voltage, Vreg1. The first regulated voltage is, thus, based on the sampled first reference voltage and is generated (906) at an output of a first voltage regulator circuit 176 on the integrated circuit, at the node 148.

At 908, the voltage multiplier circuit 172 generates a second reference voltage Vref2 on the IC (100 or 300) from an equivalent of the first reference voltage. In an embodiment (shown in FIG. 1), the first regulated voltage Vreg1 is an equivalent of the first reference voltage Vref1, and the method 900 further comprises receiving the first regulated voltage Vreg1 into an input of the voltage multiplier circuit 172, wherein the second reference voltage Vref2 is generated at an output of the voltage multiplier circuit 172 and is a multiple of the first regulated voltage Vreg1. In an alternative embodiment shown in FIG. 3, the method 900 further comprises receiving the first reference voltage Vref1 into an input of the voltage multiplier circuit, wherein the second reference voltage Vref2 is generated at an output of the voltage multiplier circuit and is a multiple of the first reference voltage Vref1.

In an embodiment, the sample and hold circuit is used, at 910, for sampling the second reference voltage Vref2, and storing, using a first capacitor 124, a value of the sampled second reference voltage for use in generating a second regulated voltage, Vreg2. The second regulated voltage is, thus, based on the sampled second reference voltage and is generated (912) at an output of a second voltage regulator circuit 174 on the integrated circuit, at the node 160. Moreover, in accordance with the teachings herein the second regulated voltage Vreg2 follows the first regulated voltage Vreg1 using a capacitive coupling between the second voltage regulator circuit 174 and the output of the first voltage regulator circuit, at the node 148. In one embodiment, the second regulated voltage Vreg2 follows the first regulated voltage Vreg1 using a capacitive connection between the output of the first voltage regulator circuit (at the node 148) and a gate terminal of an output transistor 134 of the second voltage regulator circuit 174. In an alternative embodiment, the second regulated voltage Vreg2 follows the first regulated voltage Vreg1 using a capacitive connection between the output of the first voltage regulator circuit (at the node 148) and the output of the second voltage regulator circuit (at the node 160).

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

For the sake of brevity, conventional techniques related to voltage comparator circuits, bandgap reference circuits, CMOS devices, MOSFETS, voltage reference circuits, and other functional aspects of the systems (and the individual system operating components) mentioned herein may not be described in detail. Furthermore, the connecting lines shown in the various figures contained herein are intended to represent example functional relationships and/or physical couplings between the various elements. It should be noted that many alternative or additional functional relationships or physical connections may be present in a practical embodiment. Moreover, the various IC embodiments described above may be produced or fabricated using conventional semiconductor processing techniques, e.g., well-known CMOS techniques. Further, a variety of well-known and common semiconductor materials may be used, e.g., traditional metals (aluminum, copper, gold, etc.), polysilicon, silicon dioxide, silicon nitride, silicon, and the like. In addition, for ease of discussion, the figures may illustrate example, single-ended implementations, but those skilled in the art can adapt illustrated techniques for use in differential signaling applications using the provided guidelines without departing from the scope of the present disclosure.

In this document, the terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%.

As used herein, the term "configured to", "configured with", "arranged to", "arranged with", "capable of" and any like or similar terms means that referenced circuit elements have an internal physical arrangement (such as by virtue of a particular transistor technology used) and/or physical coupling and/or connectivity with other circuit elements in an inactive state. This physical arrangement and/or physical coupling and/or connectivity (while in the inactive state) enables the circuit elements to perform stated functionality while in the active state of receiving and processing various signals at inputs of the circuit elements to generate signals at the output of the circuit elements. A device or structure that is "configured" in a certain way is configured in at least that way, but may also be configured in ways that are not listed.

As further used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common node).

The above description refers to nodes or features being "connected" or "coupled" together. As used here and, unless expressly stated otherwise, "coupled" means that one node or feature is directly or indirectly joined to (or is in direct or indirect communication with) another node or feature, and not necessarily physically. As used herein, unless expressly stated otherwise, "connected" means that one node or feature is directly joined to (or is in direct communication with) another node or feature. For example, a switch may be "coupled" to a plurality of nodes, but all of those nodes need not always be "connected" to each other; moreover, the switch may connect different nodes to each other depending on the state of the switch. Furthermore, although the various circuit schematics shown herein depict certain example arrangement of elements, additional intervening elements, devices, features, or components may be present in an actual embodiment (assuming that the functionality of the given circuit is not adversely affected).

In the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An integrated circuit for providing tracking between multiple regulated voltages, the integrated circuit comprising:

a voltage reference circuit configured to generate a first reference voltage at an output of the voltage reference circuit;

a first voltage regulator circuit having an input coupled to the output of the voltage reference circuit, wherein the first voltage regulator circuit is configured to generate, at a first terminal of a first output transistor, a first regulated voltage that is based on the first reference voltage;

a voltage multiplier circuit configured to generate, at an output of the voltage multiplier circuit, a second reference voltage from an equivalent of the first reference voltage, which is received into a first input of the voltage multiplier circuit;

a second voltage regulator circuit having an input coupled to the output of the voltage multiplier circuit, wherein the second voltage regulator circuit is configured to generate, at a first terminal of a second output transistor, a second regulated voltage that is based on the second reference voltage, wherein at least one terminal of the second output transistor is capacitively coupled to the first terminal of the first output transistor.

2. The integrated circuit of claim 1, wherein the first terminal of the first output transistor is coupled to the first input of the voltage multiplier circuit.

3. The integrated circuit of claim 2, wherein the first terminal of the first output transistor is directly connected to the first input of the voltage multiplier circuit.

4. The integrated circuit of claim 1, wherein the first input of the voltage multiplier circuit is coupled to the output of the voltage reference circuit.

5. The integrated circuit of claim 4, wherein the first input of the voltage multiplier circuit is directly connected to the output of the voltage reference circuit.

6. The integrated circuit of claim 1 further comprising a sample and hold circuit coupled between the input of the first voltage regulator circuit and the output of the voltage reference circuit and coupled between the input of the second voltage regulator circuit and the output of the voltage multiplier circuit.

7. The integrated circuit of claim 6, wherein the sample and hold circuit comprises:

a first switch connected between the input of the first voltage regulator circuit and the output of the voltage reference circuit;

a second switch connected between the input of the second voltage regulator circuit and the output of the voltage multiplier circuit, wherein the first and second switches are configured to open and close under the control of a first clock signal;

a first capacitor having a first terminal connected to the input of the first voltage regulator circuit and a second terminal connected to a virtual ground node; and a second capacitor having a first terminal connected to the input of the second voltage regulator circuit and a second terminal.

8. The integrated circuit of claim 7, wherein the second terminal of the second capacitor is connected to one of the virtual ground node or the first terminal of the first output transistor.

9. The integrated circuit of claim 7 further comprising:

a third switch coupled to the voltage multiplier circuit and configured to enable operation the voltage multiplier circuit under the control of a second clock signal; and a fourth switch coupled to the voltage reference circuit and configured to enable operation the voltage reference circuit under the control of the second clock signal.

10. The integrated circuit of claim 9, wherein the first clock signal is a delayed version of the second clock signal.

11. The integrated circuit of claim 1, wherein the capacitive coupling between the at least one terminal of the second output transistor and the first terminal of the first output transistor comprises a first capacitor having a first terminal connected to the gate terminal of the second output transistor and a second terminal connected to the first terminal of the first output transistor.

12. The integrated circuit of claim 11, wherein the capacitive coupling between the at least one terminal of the second output transistor and the first terminal of the first output transistor comprises a second capacitor having a first terminal connected to the first terminal of the second output transistor and a second terminal connected to the first terminal of the first output transistor.

13. The integrated circuit of claim 1, wherein the voltage reference circuit, the first and second voltage regulator circuits, and the voltage multiplier circuit are collectively configured to provide the second regulated voltage at a value that is higher than a value of the first regulated voltage.

14. The integrated circuit of claim 1, wherein the first regulated voltage is a supply voltage for a set of transistors of a system on chip integrated circuit, and the second regulated voltage is a well bias voltage for the set of transistors of the system on chip integrated circuit.

15. The integrated circuit of claim 1, wherein:

the first voltage regulator circuit comprises a first set of comparators coupled to the first terminal of the first output transistor, wherein the first set of comparators are configured to adjust a value of the first regulated voltage when it is outside of a first voltage range and are configured to maintain the value of the first regulated voltage when it is within the first voltage range; and the second voltage regulator circuit comprises a second set of comparators coupled to the first terminal of the second output transistor, wherein the second set of comparators are configured to adjust a value of the second regulated voltage when it is outside of a second voltage range and are configured to maintain the value of the second regulated voltage when it is within the second voltage range.

16. A method for providing tracking between multiple regulated voltages, the method comprising:

generating, on an integrated circuit, a first reference voltage;

generating a first regulated voltage that is based on the first reference voltage, wherein the first regulated voltage is generated at an output of a first voltage regulator circuit on the integrated circuit;

generating, on the integrated circuit, a second reference voltage from an equivalent of the first reference voltage;

generating a second regulated voltage that is based on the second reference voltage, wherein the second regulated voltage is generated at an output of a second voltage regulator circuit on the integrated circuit, and wherein the second regulated voltage follows the first regulated voltage using a capacitive coupling between the second voltage regulator circuit and the output of the first voltage regulator circuit.

17. The method of claim 16, wherein the first regulated voltage is an equivalent of the first reference voltage, the method further comprising receiving the first regulated voltage into an input of a voltage multiplier circuit, wherein the second reference voltage is generated at an output of the voltage multiplier circuit and is a multiple of the first regulated voltage.

18. The method of claim 16 further comprising receiving the first reference voltage into an input of a voltage multiplier circuit, wherein the second reference voltage is generated at an output of the voltage multiplier circuit and is a multiple of the first reference voltage.

19. The method of claim 16, wherein the second regulated voltage follows the first regulated voltage using at least one of:

a capacitive connection between the output of the first voltage regulator circuit and a gate terminal of an output transistor of the second voltage regulator circuit; or a capacitive connection between the output of the first voltage regulator circuit and the output of the second voltage regulator circuit.

20. The method of claim 16 further comprising:

sampling the first reference voltage, and storing, using a first capacitor, a value of the sampled first reference voltage for use in generating the first regulated voltage;

sampling the second reference voltage, and storing, using a second capacitor, a value of the sampled second reference voltage for use in generating the second regulated voltage.

* * * * *